US007566849B2

(12) United States Patent
O'Connor

(10) Patent No.: US 7,566,849 B2
(45) Date of Patent: Jul. 28, 2009

(54) SELF-REGULATING ELECTRICAL HEATING CABLE

(75) Inventor: Jason Daniel Harold O'Connor, Glossop (GB)

(73) Assignee: Heatsafe Cable Systems Limited (GB)

( * ) Notice: Subject to any disclaimer, the term of this patent is extended or adjusted under 35 U.S.C. 154(b) by 35 days.

(21) Appl. No.: 10/572,413

(22) PCT Filed: Sep. 10, 2004

(86) PCT No.: PCT/GB2004/003857

§ 371 (c)(1),
(2), (4) Date: Mar. 16, 2006

(87) PCT Pub. No.: WO2005/029920

PCT Pub. Date: Mar. 31, 2005

(65) Prior Publication Data

US 2006/0289476 A1 Dec. 28, 2006

(30) Foreign Application Priority Data

Sep. 19, 2003 (GB) ..... 0321916.9

(51) Int. Cl.
*H05B 3/34* (2006.01)

(52) U.S. Cl. ..... 219/549; 219/528; 219/529; 219/211; 219/212; 219/552; 219/553

(58) Field of Classification Search ..... 219/528–529, 219/552–3, 211–12, 549
See application file for complete search history.

(56) References Cited

U.S. PATENT DOCUMENTS

| | | | | |
|---|---|---|---|---|
| 4,200,973 A | | 5/1980 | Farkas | |
| 4,575,620 A | * | 3/1986 | Ishii et al. | 219/549 |
| 5,558,794 A | * | 9/1996 | Jansens | 219/549 |

FOREIGN PATENT DOCUMENTS

| | | |
|---|---|---|
| DE | 198 05 174 C1 | 6/1999 |
| GB | 1144856 A | 3/1969 |

OTHER PUBLICATIONS

International Search Report, dated Dec. 14, 2004, for PCT Appl. No. PCT/GB2004/003857, 2 pages.
English abstract for German Patent No. DE 19805174, 1 page.

* cited by examiner

*Primary Examiner*—Shawntina Fuqua
(74) *Attorney, Agent, or Firm*—Sterne, Kessler, Goldstein & Fox P.L.L.C.

(57) ABSTRACT

A series resistance heating cable comprises a heating element extending longitudinally along the cable. The element comprises a material having a positive temperature coefficient.

9 Claims, 1 Drawing Sheet

PRIOR ART FIG 1
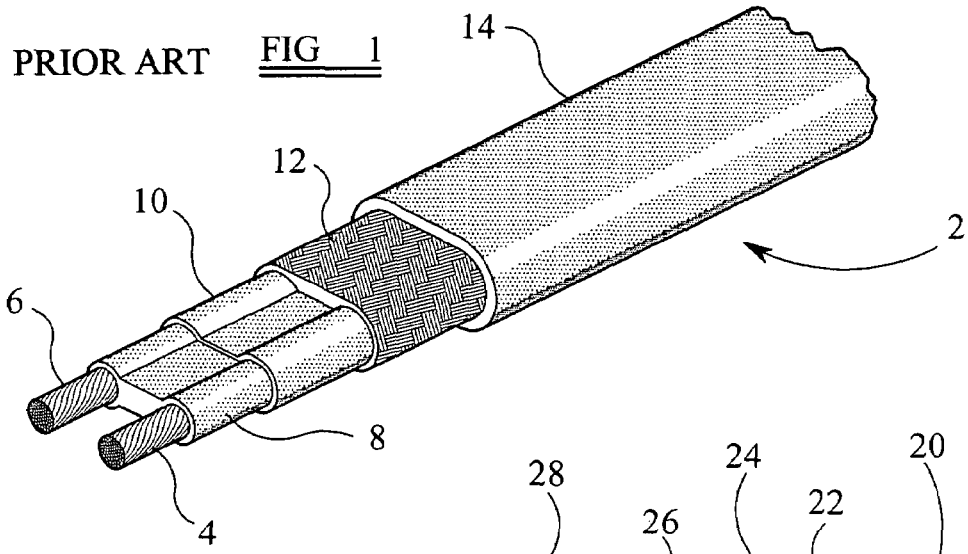
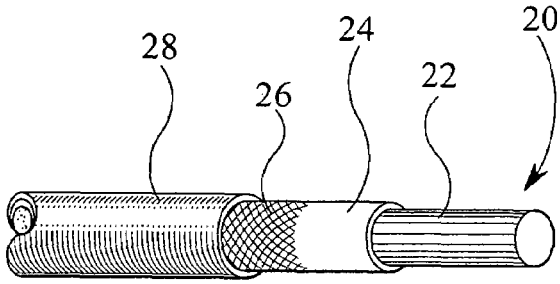
FIG 2
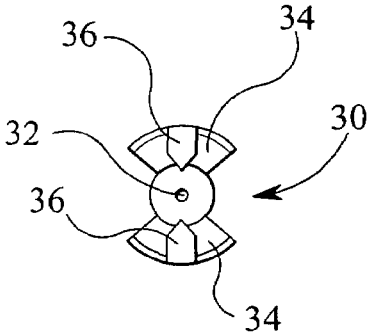
FIG 3
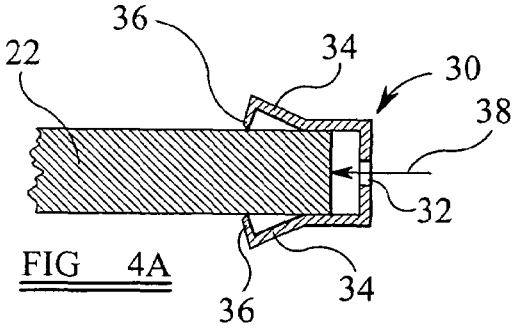
FIG 4A
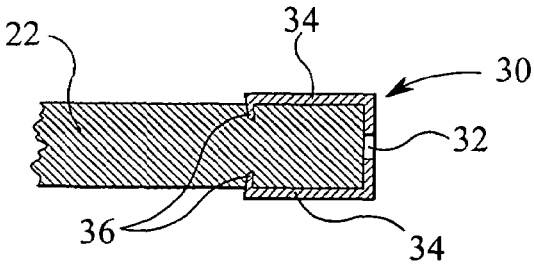
FIG 4B
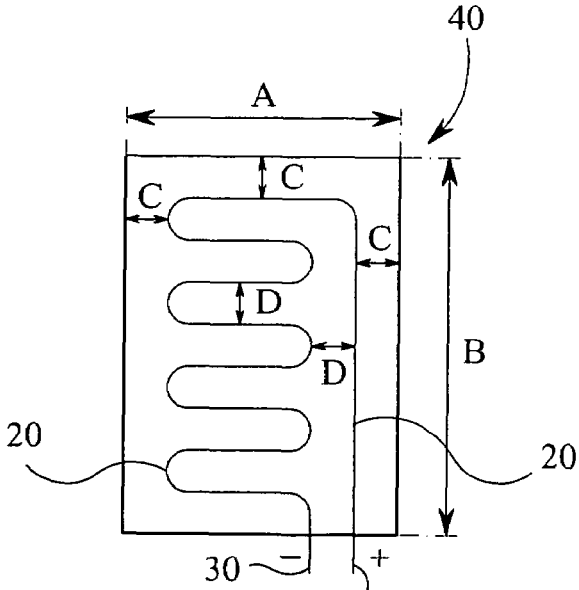
FIG 5

SELF-REGULATING ELECTRICAL HEATING CABLE

BACKGROUND

1. Field of the Invention

The present invention relates to an electrical heating cable, the power output of which is self-regulating as the result of the incorporation of a material with a positive temperature coefficient (PTC), as well as heating devices incorporating such cables.

2. Related Art

Parallel resistance semi-conductive, self-regulating heating cables are well known. Such cables normally comprise two conductors (known as buswires) extending longitudinally along the cable. Typically, the conductors are imbedded within a semi-conductive polymeric heating element, the element being extruded continuously along the length of the conductors. The cable thus has a parallel resistance form, with power being applied via the two conductors to the heating element connected in parallel across the two conductors. The heating element usually has a positive temperature coefficient. Thus as the temperature of the element increases, the resistance of the material electrically connected between the conductors increases, thereby reducing power output. Such heating cables, in which the power output varies according to temperature, are said to be self-regulating or self-limiting.

FIG. 1 illustrates a typical parallel resistance, semi-conductive, self-regulating heating cable 2. The cable consists of a semi-conductive polymeric matrix 8 extruded around the two parallel conductors 4, 6. The matrix serves as the heating element. A polymeric insulator jacket 10 is then extruded over the matrix 8. Typically, a conductive outer braid 12 (e.g. a tinned copper braid) is added for additional mechanical protection and/or use as an earth wire. Such a braid is typically covered by a thermo plastic overjacket 14 for additional mechanical and corrosive protection.

Such parallel resistance self-regulating heating cables possess a number of advantages over non self-regulating heating cables, and are thus relatively popular. For instance, self-regulating heating cables do not usually overheat or burn out due to their PTC characteristics. As the temperature at any particular point in the cable increases, the resistance of the heating element at that point increases, reducing the power output at that point, such that the heater is effectively switched off.

Further, due to this self-regulation of heating element temperature, it is often unnecessary to utilise "cold leads" with such heaters. Cold leads are often required in non-regulated heaters, as in a high temperature environment, the heating element may reach relatively high temperatures. Cold leads are connected to the ends of such non-regulated heaters to enable the heating element to be connected to the electrical supply without, for example, overheating the terminals or the supply. Cold leads typically take the form of relatively low resistance wires arranged to produce no appreciable heat. However, the fixing of the cold leads often involves costly labour. Further, the connection between the cold lead and the heater has a relatively high failure rate, due to the temperature gradient and thermal cycling experienced by the connection.

Consequently, as self-regulating heaters are typically arranged to operate within a safe temperature range, cold leads are not required.

However, parallel resistance semi-conductive self-regulating heaters do possess a number of undesirable characteristics.

The most common failure mode of parallel resistance self-regulating heaters is loss of, or reduction in, electrical contact between the power conductors and the extruded semi-conductive matrix forming the heating element. For example, differential expansion of the components and thermal cycling may lead to such failure or reduction in electrical contact. Such a reduction leads to electrical arcing within the cable, and a consequent loss in thermal output. The operational life of the product is thus dependant upon the bond between the conductors and the heating element.

Often the heating cable will be at a relatively low temperature (and hence low resistance) when initially energised. The low resistance will thus draw a high start up current when the cable is energised from cold. Consequently, circuit breakers intended to provide a first level of electrical safety (over current protection) must be sized to allow much higher currents (often by a factor of 6) than the normal run or operating current. This results in a lowering of circuit safety and oversized switch gear and components.

SUMMARY

It is an object of the present invention to provide an electric heating cable that substantially obviates or mitigates one or more of the problems of the prior art, whether referred to herein or otherwise.

According to a first aspect, the present invention provides a series resistance heating cable comprising a heating element extending longitudinally along the cable, the element comprising a material having a positive temperature coefficient.

By providing a self-regulating heating cable having a series architecture, the life expectancy of the cable is increased. Further, the start up current decreases compared with a similar parallel resistance self-regulating heating cable.

The cable may be a self-regulating cable.

The material may be a semi-conductor.

The material may comprise a polymer.

The material may comprise a high density polyethylene matrix including carbon.

The heating cable may further comprise at least one conductive terminal located at an end of the cable, and in electrical contact with the heating element via a conductive paste.

The conductive paste may comprise silver.

According to a second aspect, the present invention provides a heating device comprising a heating cable as described above.

The heating device may be a car seat heater.

According to a third aspect, the present invention provides a method of manufacturing a series resistance heating cable, the method comprising the step of providing a heating element extending longitudinally along the cable, the element comprising a material having a positive temperature coefficient.

According to a fourth aspect, the present invention provides a method of manufacturing a heating device, the method comprising providing a series resistance heating cable having a heating element extending longitudinally along the cable, the element comprising a material having a positive temperature coefficient.

Embodiments of the present invention will now be described, by way of example, with reference to the accompanying drawings, in which:

BRIEF DESCRIPTION OF THE DRAWINGS/FIGURES

FIG. 1 is a partially cut away perspective view of a known parallel resistance self-regulating heating cable;

FIG. 2 is a partially cut away perspective view of a cable in accordance with an embodiment of the present invention;

FIG. 3 is an end view of a terminal for connecting to the cable illustrated in FIG. 2;

FIGS. 4A and 4B illustrate the terminal of FIG. 3 being connected to the cable of FIG. 2; and FIG. 5 is a schematic representation of a heating device in accordance with an embodiment of the present invention.

DETAILED DESCRIPTION

The present inventor has realised that a series resistance self-regulating heating cable combines the benefits of the parallel resistance self-regulating heating cables, but with less disadvantages.

FIG. 2 illustrates a series resistance self-regulating heating cable in accordance with an embodiment of the present invention. The heating cable 20 comprises a heating element 22 extending longitudinally along the cable. The heating element 22 has a positive temperature coefficient, such that resistance of the element increases with temperature. Preferably, the element comprises a semi-conductive material shaped as a wire or string. One example of a suitable material is semi conductive high density polyethylene (HDPE), such as carbon loaded polyethylene. Typically, the element will have a substantially circular cross section, of diameter 2 mm.

A primary insulation jacket or coating 24 surrounds the heating element 22, and is used to electrically insulate the element 22 from the surroundings. Typically, this primary insulation jacket 24 is formed of a polymer such as polyolefin, of approximate thickness 0.8 mm.

A conductive outer braid 26 (e.g. copper braid typically of approximate thickness 0.5 mm) can optionally be added for additional mechanical protection and/or use as an earth wire. Such a braid may also be covered by a thermo plastic outer jacket for additional mechanical protection, typically of approximate thickness 0.6 mm.

Although series resistance heating cables are known, such cables comprise a metallic heating resistance wire having a substantially constant electrical resistance. Such cables thus have a substantially constant power output, irrespective of the temperature of the heater. In high temperature environments, such series heaters continue to produce the designed heating load, which may result in over-heating or burn out of the heater unless externally controlled. This is a major disadvantage of known series resistance heaters.

However, by providing a heating element with a positive temperature coefficient, then when any portion of the heater is subjected to a high temperature, power output from the heater is reduced to prevent over-heating or burn out. Further, because the described embodiment is self-regulating, it may be arranged for connection directly to power supply terminals without the need to fix separate cold leads. This obviates the attendant material and labour costs, and removes the possibility of failure at a hot/cold joint. Preferably, the heating element is formed of polymeric and/or semi-conductive material. Such materials are particularly suitable for self-regulating heater cables, as they have a relatively large PTC. In other words, the resistance of the material changes significantly for a predetermined temperature range. For instance, the resistance may change by 50% over a 100° C. temperature range. In polymeric materials, this change in resistance is typically due to the polymer expanding and at least partially breaking the conductive path between the two conductors.

In addition to the aforesaid advantages of the embodiment, which are typically shared by the parallel resistance self-regulating heating cable, other advantages also arise due to the series architecture.

Compared with a similar parallel-resistance self-regulating heating cable, a series resistance self-regulating heating cable experiences a lower inrush current on cold start up. This is because the inrush current is inversely proportional to the distance that separates the live and neutral terminals. In a parallel cable the two conductors are close together, typically 8 mm apart. The applied mains voltage can easily 'jump' across the two buswires via the carbon loaded semi-conductor. Conversely, in the series architecture, the two terminals are some distance apart, typically metres as opposed to millimeters, and hence inrush is inhibited. For example, a typical parallel-resistance self-regulating heating cable rated at 30 watts per meter might have a cold start resistance of approximately 300Ω, rising to a stable resistance of around 2 kΩ after a predetermined time period. In other words, the resistance of the cable changes by at least an order of magnitude. In contrast, a similarly rated series resistance cable might have a cold start resistance of 1-1.5Ω, rising to a stable resistance of 2 kΩ. It-will this be appreciated that the resistance change of the series cable is lower than the resistance change of the similar parallel cable, with the series cable thus having a lower inrush current on cold start up. Consequently, over-current protection devices may therefore be sized closer to the operating current, thereby improving circuit safety, and decreasing the amount by which switch gear and components have to be over-sized. Additionally, series resistance self-regulating heating cables are less susceptible to failure than parallel resistance self-regulating heating cable. This is because in a series self-regulating heating cable, good electrical contact between the power conductors and the element need only be made at the two ends of the series cable, as opposed to a continuously good contact along the whole length of the parallel cable. Further, as the contacts with the conductors are made at the end of the cable, should repair or replacement of the contact prove necessary, this is readily accomplished.

FIG. 3 shows an end view of a terminal 30 suitable for making an electrically conductive connection with an end of the heating cable. Preferably, a similar connection is made at each end of the cable. FIG. 4A illustrates a cross sectional view of the terminal being applied to the heating element 22 located at one end of the cable 20, whilst FIG. 4B illustrates the terminal in situ. The terminal is connected to a conductive lead (not shown), which is in turn connected to a power supply suitable for supplying power to operate the heater.

The terminal 30 comprises a body 32 defining an aperture. Legs 34 extend away from the body 32. Located at an end of each leg distant from the body 32 is a jaw 36. In use, the jaw 36 is arranged to dig into and grip a surface e.g. the jaw 36 is arranged to be imbedded within the surface of the heating element 22.

As can be seen in FIGS. 4A and 4B, the terminal 30 is located with the body 32 adjacent an end of the longitudinally extending heating element 22. The legs 34 extend along the sides of the heating element 22. A conductive paste (e.g. a silver paste) is injected through the aperture (in the direction shown by arrow 38) in the body 32, so as to fill the void between the end of the cable and the adjacent surface of the terminal body 32. Subsequently, the paste is set, ensuring a good electrical contact between the terminal and the heating element. Should electrical contact be lost, a new conductive paste coating may be readily applied.

Additionally, pressure is applied to the ends of the legs 34 distant from the body 32, so as to embed the jaws 36 within the element 22.

Such a series resistance self-regulating heating cable is suitable for use on a variety of heating devices and applications. It is particularly suitable for use in devices of known, predetermined length. This enables easier sizing of the heating device.

It has been appreciated by the present inventor that series resistance self-regulating heating cables comprising PTC materials are particularly suitable for use in heating devices or arrangements in which it is desirable to selectively heat a portion of the device in contact with an external body e.g. car seat heaters or motor cycle handle bar grip heaters. One example of such a material is carbon loaded polyethylene.

FIG. 5 illustrates a plan view of a car seat heater arrangement, showing the layout of the series resistance self-regulating heating cable 20 within the car seat heater 40.

The overall width A of the heater 40 is approximately 600 mm with a length B of approximately 900 mm. Apart from the ends of the cable provided with a terminals 30 for connection to a power supply, the cable 20 is distributed so as to maintain a distance of at least C from the periphery of the heater. Typically, C is 100 mm. The cable is arranged within the car seat heater so as to be substantially evenly distributed within the car seat, with typical cable spacing being D, a distance of approximately 100 mm.

Such an arrangement tends to provide a total cable length of approximately 3000 mm. For a 3 W/m rated cable, this typically results in a circuit resistance of approximately 16 ohms, whilst for a 7 W/m cable this would result is a circuit resistance of approximately 6.9 ohms.

In normal operation, the cable will emit heat, so as to warm the car seat. If a user contacts the surface overlying a portion of the cable, then this will result in an increase in temperature of that portion due to the rate of heat loss being decreased by the relatively warm body of the user. It will consequently be realised that, due to the element comprising a PTC material, the areas of the seat contacted by a user (eg. sat upon) will experience an increase in resistivity. This increase in resistivity will lower the overall heat output from the cable, as the total resistance of the cable will increase. However, for those areas in which the resistance increases, due to the serial nature of the cable, the heat emitted from those areas will be higher than the heat emitted from other, lower resistance areas where the users body mass is not present. The use of a series resistance cable with a PTC will thus provide a heater in which the majority of the heat is emitted from the area contacted by a user, whilst the PTC ensures this area is only maintained at a reasonable temperature that does not burn the user.

The invention claimed is:

1. A series resistance self-regulating heating cable comprising:

a heating element extending longitudinally along the cable, wherein the heating element comprises a semi-conductor having a positive temperature coefficient; and at least one conductive terminal coupled to an outside surface of the cable, electronically connected to the heating element, and located at an end of the cable.

2. The heating cable as claimed in claim 1, wherein said semi-conductor comprises a polymer.

3. The heating cable as claimed in claim 1, wherein said semi-conductor comprises a high density polyethylene matrix including carbon.

4. The heating cable as claimed in claim 1, the at least one conductive terminal being in electrical contact with the heating element via a conductive paste.

5. The heating cable as claimed in claim 4, wherein said conductive paste comprises silver.

6. A heating device, comprising:

a series resistance self-regulating heating cable including a heating element extending longitudinally along the cable, wherein the heating element includes:

a semi-conductor having a positive temperature coefficient; and at least one conductive terminal coupled to an outside surface of the cable, electronically connected to the heating element, and located at an end of the cable.

7. The heating device as claimed in claim 6, wherein said heating device is a car seat heater.

8. A method of manufacturing a series resistance self-regulating heating cable, comprising:

extending a heating element longitudinally along the cable, wherein the heating element includes:

a semi-conductor having a positive temperature coefficient; and at least one conductive terminal coupled to an outside surface of the cable, electronically connected to the heating element, and located at an end of the cable.

9. A method of manufacturing a heating device, comprising:

producing a series resistance self-regulating heating cable having a heating element extending longitudinally along the cable, wherein the heating element includes:

a semi-conductor having a positive temperature coefficient; and at least one conductive terminal coupled to an outside surface of the cable, electronically connected to the heating element, and located at an end of the cable.

* * * * *